United States Patent [19]

Matsuda

[11] Patent Number: 4,565,585

[45] Date of Patent: Jan. 21, 1986

[54] METHOD FOR FORMING A CHEMICAL CONVERSION PHOSPHATE FILM ON THE SURFACE OF STEEL

[75] Inventor: Shigeki Matsuda, Okazaki, Japan

[73] Assignee: Nippondenso Co., Ltd., Kariya, Japan

[21] Appl. No.: 641,484

[22] Filed: Aug. 16, 1984

[30] Foreign Application Priority Data

Aug. 19, 1983 [JP] Japan ..... 58-152150

[51] Int. Cl.[4] ..... C23F 7/10

[52] U.S. Cl. ..... 148/6.15 R; 148/6.15 Z

[58] Field of Search ..... 148/6.15 R, 6.15 Z

[56] References Cited

U.S. PATENT DOCUMENTS

| | | | |
|---|---|---|---|
| 3,312,189 | 3/1967 | McVey | 118/7 |
| 3,369,928 | 2/1968 | Arlow | 148/6.15 Z |
| 3,515,094 | 6/1970 | McVey | 148/6.15 Z |
| 3,674,672 | 7/1972 | Whitesell | 204/195 |
| 4,089,710 | 5/1978 | Cooke | 148/6.15 Z |
| 4,110,127 | 8/1978 | Longuepee | 148/6.15 R |
| 4,140,551 | 2/1979 | Jones | 148/6.15 |
| 4,182,638 | 1/1980 | Cook | 148/6.15 R |
| 4,233,087 | 11/1980 | Cooke | 148/6.15 |

FOREIGN PATENT DOCUMENTS

| | | |
|---|---|---|
| 1011177 | 4/1965 | United Kingdom . |
| 1113270 | 6/1968 | United Kingdom . |

OTHER PUBLICATIONS

Woods et al.: "Zinc Phosphating", *Metal Finishing*, Apr. 1979, pp. 56–60.

Gutcho, Ed.: "Phosphatizing", *Metal Surface Treatment*, Noyes Data Corporation, New Jersey, 1982, pp. 3–13.

"Uber den Einflub einer Vorbehandlung vor dem Phosphatieren . . . ", Werkstoffe und Korrosion, Jahygang 1963, Heft. 7, pp. 566–574, (no translation).

"Uber die Wesentlichen Merkmale . . . Reaktionsmechanismus in Letzteren", Werkstoffe und Korrosion, Jahrgang 1963, Heft. 4, pp. 273–279, (no translation).

"Electrochemische und Kristallisationserscheinungen . . . Metallen", Neue Hutte, 14 Jg. Heft 4, pp. 238–241, (no translation).

"Die Kinetik der Bildung von Phosphatuberzugen," Fette. Seifen. Anstrichmittel. 70 Jahrgang Nr. 8, pp. 549–556, (no translation).

*Primary Examiner*—Sam Silverberg

*Attorney, Agent, or Firm*—Cushman, Darby & Cushman

[57] ABSTRACT

The present invention proposes a method for forming a chemical conversion phosphate film on the surface of steel, characterized in that the temperature of the conversion bath is from 0° C. to 40° C., the hydrogen-ion concentration (pH) of the conversion bath is in the range of from pH 2.2 to pH 3.5, and the oxidation reduction potential of the conversion bath is from 0 mV to 700 mV (normal hydrogen electrode potential).

According to the present invention, normal-temperature phosphating and automatic bath control are attained.

10 Claims, 6 Drawing Figures

METHOD FOR FORMING A CHEMICAL CONVERSION PHOSPHATE FILM ON THE SURFACE OF STEEL

The present invention relates to a method for forming on the surface of steel a chemical conversion phosphate film, such as zinc phosphate or the like.

DESCRIPTION OF THE PRIOR ART

A phosphate coating is formed on the surface of a steel sheet as a paint base for the purpose of enhancing corrosion resistance or adhesion. In addition, a phosphate coating is applied on the surface of friction and sliding steel materials for the purpose of improving their sliding characteristics.

Conventionally, the chemical conversion process for applying a phosphate coating is carried out by maintainig the temperature of the conversion bath at 40° C. or higher and by measuring, the total acids, the free acids, the oxidizer, and the like by chemical volumetric analysis. Based on this analysis, main agents, which contain phosphate ions and metal ions, such as zinc ions, and auxiliaries, which contain nitrite ions, are replenished to the conversion bath at an amount which is determined based on the results of the chemical volumetric analysis and which is adjusted taking into consideration the operator's experience. However, satisfactory bath control is difficult since time is consumed until the results of chemical volumetric analysis are revealed, and, further, reactions which appear to the operator to be abnormal can occur in the conversion bath. As a result, the quality of the phosphate coating greatly varies, and when the painting is applied on coversion-treated steel sheets, problems may occur; for example, the painting film may not exhibit a satisfactory corrosion resistance.

"Zinc Phosphating" By Woods and Springs (Metal Finishing March 1979 pp 24–28) describes the chemical reaction according to a conventional zinc phosphating method.

SUMMARY OF THE INVENTION

The present inventor studied bath control in the conversion treatment of steel from the viewpoint of the chemical reactions occurring in the conversion bath and discovered: that when the temperature of the conversion bath is high, the chemical reactions are liable to be influenced by the heat of the conversion bath so that abnormal reactions occur; and that, on the other hand, when the temperature of the conversion bath is low, e.g., a normal temperature, the electrochemical general corrosion reactions of steel become predominant, and, hence, the chemical reactions occurring in the conversion bath are stabilized so that bath control is facilitated and a dense phosphate coating is formed with the chemical conversion treatment.

It is, therefore, an object of the present invention to provide a method for applying, on the surface of steel, a phosphate coating by a chemical conversion treatment in which chemical volumetric analysis for bath control is not carried out.

It is another object of the present invention to provide a chemical conversion phosphating method which attains simple bath control, especially automatic bath control.

It is a further object of the present invention to provide a normal-temperature conversion method in which a phosphate coating is reliably formed.

It is yet another object of the present invention to provide a chemical conversion phosphating method in which the treating agents used for phosphating are reduced as compared with a conventional method.

The method according to the present invention is characterized in that the temperature of the conversion bath is from 0° C. to 40° C., the hydrogen-ion concentration of the conversion bath is in the range of from pH 2.2 to pH 3.5, and the oxidation reduction potential (ORP) of the conversion bath is from 0 mV to 700 mV (normal hydrogen electrode potential).

REACTIONS OF PHOSPHATING PROCESS

The conversion bath comprises three components. One of the components, hereinafter referred to as the main agent, substantially consists of $H_2PO_4^-$($H_3PO_4$), $NO_3^-$, and metal ions, such as a $Zn^{2+}$ ions. Another component, hereinafter referred to as the auxiliary A, comprises an oxidizer, such as $NO_2^-$ or the like. The other component, hereinafter referred to as the auxiliary B, comprises a hydroxide ions ($OH^-$). The conversion bath is an aqueous solution of the main agent, the auxiliary A, and the auxiliary B.

The metal ions which are comprised in the main agent are not limited to zinc ions and can be manganese, calcium, magnesium ions, or the like, which, like zinc, is present in the aqueous solution as a stable hydrogen phosphate compound and which exhibits a great decrease in solubility due to dehydrogenation according to the following formula:

$$M_x(H_2PO_4)_y \rightarrow M_x(PO_4)_y + 2_yH^+ \quad (1)$$

Metal ions other than zinc, such as nickel, cobalt, manganese or the like, are usually added to the main agent for the purpose of effectively carrying out the dehydrogenation (oxidation) reaction according to the formula (1). Such metal ions as nickel or the like can be used for the conversion bath according to the method of the present invention as well as in a conventional method.

The role of the oxyacid anions comprised in the main agent, such as $NO_3^-$ and $ClO_3^-$, is to make such constituents of the coating as $H_2PO_4^-$ and $Zn^{2+}$ water-soluble in the conversion bath. In addition, the oxyacid anions promote a cathode reaction which occurs on the steel surface during the electrochemical reactions, thereby assisting in the formation of the coating.

The components of the auxiliaries A and B participate in the electrochemical reactions and assist the components of the main agent in the formation of the coating.

According to a feature of the present invention, an electrochemical general corrosion reaction occurs on the surface of steel, with the result that a phosphate coating is formed on the entire surface of the steel. The electrochemical general corrosion reaction herein is a reaction in which anode reactions (an oxidation reactions such as the dissolving of metal) and a cathode reaction (a reduction reaction) simultaneously occur on the surface of metal. In this reaction, the steel surface is uniformly corroded or dissolved. Since the composition and the concentration of the anions are appropriately selected in the method of the present invention, corrosion products are uniformly formed on the steel surface as the coating, and the so-formed coating suppresses the subsequent dissolution of the steel.

The anode reactions of the electrochemical general corrosion reaction are:

$$Fe \rightarrow Fe^{2+} + 2e\ (-0.44\ V) \quad (2),$$

$$Fe^{2+} + H_2PO_4^- \rightarrow FePO_4 \downarrow + 2H^+ + e \quad (3), \text{ and}$$

$$3Zn^{2+} + 2H_2PO_4^- \rightarrow Zn_3(PO_4)_2 \downarrow + 4H^+ \quad (4).$$

The cathode reaction of the electrochemical general corrosion reaction is:

$$NO_2^- + 2H^+ + e \rightarrow NO \uparrow + H_2O\ (1.0\ V) \quad (5)$$

The potentials given in the formulas (2) and (5) indicate the normal hydrogen electrode potentials at 25° C.

Incidentally, the chemical reaction proceeds in a direction which decreases the Gibbs' free energy ($\Delta G$) of the entire reaction system. The electrochemical reaction system occurring on the metal surface for forming the phosphate coating can be deemed to be formed by the reactions (2), (3), (4), and (5). If the Gibbs' free energy ($\Delta G$) decreases in this reaction system at a normal temperature, the reactions can proceed without heat being applied to the reaction system, and, hence, the formation of a coating is possible at a normal temperature. According to a discovery made by the present inventor, reactions for forming a phosphate coating cannot be carried out at the normal temperature conventionally because the reaction system which is formed by the reactions (2), (3), (4), and (5) cannot be reliably controlled.

The present invention recognizes that the reactions for forming a phosphate coating on a steel surface are fundamentally the electrochemical reactions (2), (3), (4), and (5). Based on this recognition, the present invention proposes a method of controlling these electrochemical reactions in which the continual existence of excessive inhibiting matter, such as sludge ($Zn_3(PO_4)_2$) or the like, in the reaction system is prevented, thereby making it possible to form a coating at a normal temperature.

LOW TEMPERATURE OF CONVERSION BATH

In the present invention, the following features are attained:

(1) It is possible to form a phosphate coating at a normal temperature (40° C. or less).

(2) The reactions for forming the phosphate coating can be automatically controlled.

When the temperature of the conversion bath is 40° C. or less, non-electrochemical reactions (thermal reactions such as thermal decomposition) which occur in a conventional bath can be suppressed and the electrochemical general corrosion reaction can be utilized for forming the conversion coating.

HEAT APPLIED TO CONVERSION BATH

Generally, when heat is imparted to the reaction system from outside the system, the chemical reaction proceeds endothermically so that the entropy ($\Delta S$) of the system increases. Since the thermal decomposition reaction which occurs in an externally heating system due to the high temperature, hydrogen ions ($H^+$) and electrons ($e^-$) cannot coexist in the reaction system, and, hence, the reaction becomes non-electrochemical. In the heated bath for the phosphating treatment, in addition to the above-mentioned electrochemical reactions (2), (3), (4), and (5), the decomposition reactions (6) and (7)

$$NO_2^- \rightarrow NO_2 \uparrow + e \quad (6)$$

$$H_3PO_4 \rightarrow H^+ + H_2PO_4^- \quad (7)$$

seem to be strong.

The reactions (8) and (9)

$$H^+ + e \rightarrow \tfrac{1}{2}H_2 \uparrow \quad (8)$$

$$3Zn^{2+} + 2H_2PO_4^- + 4e \rightarrow Zn_3(PO_4)_2 \downarrow + 2H_2 \uparrow \quad (9)$$

seems to proceed as a result of the occurrence of the reactions (6) and (7).

In a high-temperature conversion bath, the nitrite ions are consumed and $NO_2$ gas is generated according to the formula (6), $H_2$ gas is generated according to the formula (8), and sludge, i.e., $Zn_3(PO_4)_2$, is formed according to the formula (9). The components of the conversion bath are therefore consumed as $NO_2$ gas $H_2$ gas, and sludge at a high temperature, with the result that the components must be incorporated into the conversion bath at an amount greater than that required for forming the phosphate coating.

Since the temperature of the conversion bath is 40° C. or less according to the present invention, the reactions (6) and (7) are so drastically suppressed that the anions and cations are stably present in the conversion bath. This in turn leads to the suppression of the reactions (8) and (9), with the result that the generation of $H_2$ gas and sludge can be suppressed. In a normal-temperature bath having a temperature of 40° C. or less, the inhibiting reaction and the formation of inhibiting matter can be suppressed and the coating formation reactions can effectively take place.

REACTION RATE IN LOW-TEMPERATURE BATH

Incidentally, in order for the formation reactions of the phosphate coating to be carried out at a normal temperature in an ordinary production line, the reaction rate needs to be sufficiently high. The factors of the rate of reactions occurring on the electrode are (a) the concentration of the reactants, i.e., matter which participates in the reactions, (b) the concentration of the matter which inhibits the reactions, (c) temperature, (d) pressure, and (e) electrode potential. The higher the temperature is, the greater the reaction rate is. In order to prevent the inhibiting reactions accompanying gas generation, shown in the formulas (6), (8), and (9) the temperature should be low. The pressure is constant in the case of the immersion-type phosphating process. In the case of the spray-type phosphating process, the higher the pressure is, the greater the reaction rate is. Regarding the concentration of the reactants, the greater the amount of the oxidizer and the hydrogen ions is, the greater the rate of the dissolution reaction of iron is according to the formula (2). In the formation reactions of coating according to the formulas (3) and (4), the hydrogen concentration should be less than a certain level so as to attain a high reaction rate. Regarding the electrode potential, at least one requirement should be satisfied. That is, the reaction potential of the oxidizer (the cathode reaction potential) should be greater than the iron-dissolution reaction potential (anode potential).

In order to proceed electrochemically with the reactions for forming the phosphate coating on the steel surface at a high reaction rate, the following two requirements should be satisfied:

(A) The compositions of the conversion bath and the metallic workpiece should be determined so that the surface of the metallic workpiece is dissolved in the conversion bath at a satisfactorily high rate at a normal temperature.

(B) The concentrations of the matter participating in the reactions, such as the conversion-coating agent, the oxidizer, and the hydrogen ions, should be maintained within such a range that the phosphate coating can be formed at a normal temperature.

The requirement A is satisfied by using, for treating the steel workpiece, a conventional conversion bath composed of a main agent consisting of phosphate ions, nitrate ions, zinc ions, and the like and an auxiliary A mainly consisting of nitrite ions as the oxidizer.

The requirement B is satisfied (1) when the sludge is in a satisfactorily low amount, (2) when the concentration of the nitrate ions relative to the phosphate ions is less than a critical value, which is, in the case of $NO_3^-$, one-half or less of the $H_2PO_4^-$ concentration, and also when the hydrogen ion concentration is from pH 2.2 to pH 3.5 and the concentration of the nitrite ions as the oxidizer is from 0 to 700 mV in terms of the ORP.

According to a feature of the present invention, the auxiliary B comprises $OH^-$ ions, and the $OH^-$ ions make it possible to remove the $NO_3^-$ ions from the conversion bath, thereby providing the condition (2) above. Since a normal-temperature conversion bath virtually is not influenced by thermal energy, the balance of the components of the normal temperature-conversion bath is more important than in a high-temperature conversion bath. That is, the concentration balance of the $H_2PO_4^-$, $NO_3^-$, $Zn^{2+}$, $NO_2^-$, and sludge ($Zn_3(PO_4)_2$) needs to be constantly maintained within the normal-temperature-conversion bath.

ORP and PH Control

It is very clear that the $H_2PO_4^-$ and $Zn^{2+}$ concentrations decrease with the formation of a coating. The $NO_2^-$ as the oxidizer is incorporated into the conversion bath with the control of not the pH but the ORP value according to a feature of the present invention.

It is well known that when the relative concentration of $NO_3^-$ increases, the pH decreases and the formation of a coating is inhibited. Such relative increase of $NO_3^-$ also occurs when a long operation is carried out using a normal-temperature conversion bath. The removal of $NO_3^-$ to maintain the balance of the bath composition is now described in detail.

The ORP of the bath according to the present invention is from 0 to 700 mV in terms of the normal hydrogen electrode potential. It is therefore possible when the pH of the conversion bath is decreased to less than a predetermined value to incorporate an alkali into the conversion bath, thereby enabling the start of an anode reaction according to the following formula:

$$40H^- \rightarrow O_2 + 2H_2O + 4e \text{ (0.401 V or more)} \quad (10)$$

The reaction of the formula (10) electrochemically reacts with $NO_3^-$ in the conversion bath, and $NO_3^-$ is removed from the conversion bath according to the formulas (11) and (12):

$$2NO_3^- + 4H^+ + 2e \rightarrow N_2O_4 \uparrow + 2H_2O \text{ (0.803 V)} \quad (11)$$

$$NO_3^- + 2H^+ + 2e \rightarrow NO_2^- + H_2O \text{ (0.94 V)} \quad (12)$$

Accordingly, a reduction in the pH of the conversion bath can be prevented, and, simultaneously, $NO_3^-$ can be removed by incorporating upon a decrease of the pH value, the auxiliary B, which comprises $OH^-$, into a normal-temperature conversion bath having a critical ORP. This ORP value is, for example, 300 mV or more and is determined by the potential of the reactions (10) to (12), taking into consideration a potential decrease due to slight sludge formation which is not desirable but may accidentally occur in the method of the present invention. Contrary to this, in a high-temperature conversion bath, the removal of the $NO_3^-$ from the bath may occur in accordance with the formulas (11) and (12), but the removal is not electrochemical. Such removal occurs as a result of a decrease in the heat content ($\Delta H$) of the system.

The alkali, which can be used as the auxiliary B, may be at least one member selected from the group of caustic soda, caustic potash, and an alkaline salt, such as sodium carbonate, the aqueous solution of which is alkaline.

As is described above, an appropriate incorporation of alkali and, hence, $OH^-$ allows the removal of $NO_3^-$ as is shown in the formulas (10), (11), and (12). However, if $OH^-$ is incorporated excessively, not only is $NO_3^-$ removed but also $OH^-$ reacts with $H_2PO_4^-$, resulting in the formation of sludge according to the following formula:

$$3Zn^{2+} + 2H_2PO_4^- + 4OH^- \rightleftarrows Zn_3(PO_4)_2 \downarrow + 4H_2O \quad (13)$$

As a result, the ORP of the conversion bath varies according to the formula (13). In addition, since the reaction (13) is reversible, the variation of the ORP is great.

It is obvious that even in a conversion bath containing a large amount of sludge formed according to the formula (13), reactions for forming the coating can occur since a conventional high-temperature bath contains a large amount of sludge. The ORP of the conversion bath is indicated by the reaction (13) and is from 0 to 300 mV and, hence, low. The coating can be formed at an ORP of from 0 to 300 mV and may be impaired due to the existence of sludge. Nevertheless, an ORP within a range of from 0 to 700 mV is attained in a conversion bath containing a large amount of sludge.

In a conventional high-temperature conversion bath, the pH ranges from 3.0 to 3.4 in the case of spray-type phosphating and from 1.0 to 3.0 in the case of immersion-type phosphating. The pH according to the method of the present invention is from 2.2 to 3.5 and lies within a broad range since sludge is not liable to form due to a bath temperature of 40° C. or less, and, hence, the reactions (3) and (4) occur on the steel surface. Incidentally, if the pH is less than 2.2, the formation of a coating according to the reactions (3) and (4) is suppressed.

Regarding the measurement of the pH and ORP, the pH and ORP values measured at a high temperature are different from those measured at a low temperature. As is known, the concentration of the free acid increases with a temperature drop. The temperature at which the pH and the ORP are measured influences their values.

The pH and ORP values herein are those measured at the operating temperature of the conversion bath.

An ORP value in the range of from 0 to 700 mV (normal hydrogen electrode potential) is lower than the ORP value of a conventional conversion bath (730 mV or more) operated at a high temperature. In a conventional conversion bath, since self-decomposition of the bath components according to the formulas (6) to (9) is promoted due to heating, the bath components need to be constantly replenished.

In replenishing the bath components, in addition to the main agent, a large amount of the oxidizer is added to the conversion bath. A high ORP according to a conventional high-temperature conversion bath seems to result from the synergistic effect of the oxidizer and high-temperature heating. From another point of view, in a conventional high-temperature conversion bath, a large amount of sludge, which has the same components as the coating, is present, and, hence, a large force is required to promote the formation reaction of the coating on the steel surface. Such a force is heat. In addition, matter, other than phosphate, participating in the conversion reactions, i.e., the oxidizer, is used in a large amount. As a result, the ORP becomes high due to the heat and the oxidizer, and this high ORP must be constantly main-tained to form a coating.

Since, according to the present invention, only a small amount of sludge is present in the conversion bath and the bath temperature is low, the conversion reactions ideally occur electrochemically without waste or loss, and, a satisfactory formation re-action of the coating can be attained at a broader pH range and a lower ORP than those of the conventional method.

The present invention is hereinafter further described with reference to the drawings.

BRIEF DESCRIPTION OF THE DRAWINGS

Referring to FIG. 1, the rectangular region denoted by A shows the pH and ORP ranges according to the present invention. The region denoted by p shows the pH and ORP ranges according to a conventional method.

Figure 1:
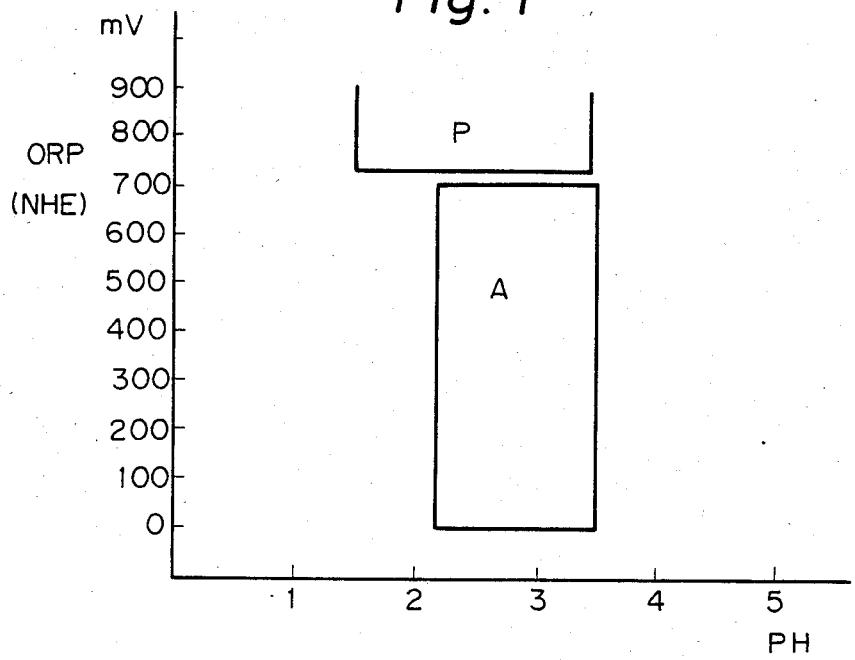
FIG. 1 is a graph showing the ORP and the pH according to the method of the present invention and a conventional method.

The metal to be treated by the method of the present invention is steel. The steel herein includes ordinary iron or steel, alloyed steel, and surface-treated steel, such as galvanized steel.

Bath Control

The bath control according to the present invention can be automatized by measuring the pH and the ORP values since the forming reactions of the coating are electrochemical. During the treatment of steel, the phosphate ions ($H_2PO_4^-$) and zinc ions ($Zn^{2+}$) of the main agent and the components of the auxiliary A (an oxidizer such as nitrite ions) are removed from the conversion bath.

The concentrations of the main agent and the components of the auxiliary A have an interrelationship with the pH and the ORP. That is, since the relative amount of $NO_3^-$ increases in accordance with the formation of the coating, which accompanies a decrease of $H_2PO_4^-$ and $Zn^{2+}$, the pH of the conversion bath decreases. The decreased pH can be brought back to a high value by incorporating $OH^-$ into the conversion bath and hence removing $NO_3^-$. When the above-mentioned components of the auxiliary A decrease, the ORP of the conversion bath decreases.

Bath control can therefore be carried out as follows. Upon an increase of the pH to 3.0 or more, the feeding valve is opened or a pump is actuated to feed the main agent into the conversion bath, and upon a decrease of the pH to 2.7 or less, the valve is closed or the actuation of the pump is stopped. In this case, the main agent is an acidic solution which comprises zinc ions, phosphate ions, and nitrate ions. The auxiliary B is incorporated into the conversion bath so as to replenish the alkali of the auxiliary B in the conversion bath, thereby preventing, the pH decrease to a certain value, e.g., 2.7 or less. This replenishing of the auxiliary B can be automatized as follows. Upon a decrease of the pH of the conversion bath to 2.7 or less, replenishing of the auxiliary B is initiated. After the passage of the time set by the times or a pH increase of 2.75 or less, the replenishing of the auxiliary B is stopped.

The replenishing of the auxiliary A can be automatized, for example, as follows. The feeding valve is opened or the pump is actuated to feed the auxiliary A into the conversion bath at an ORP of 400 mV or less and is closed at an ORP of 500 mV or more. The measurement of both the pH value and the ORP value is an electrochemical one not necessitating chemical analysis and therefore is very simple. Bath control can therefore be automatized as described above.

The components of the main agent of the conversion bath can be, for example, (A) 5,000 ppm of zinc ions, 15,000 ppm of phosphate ions, 4,500 ppm of nitrate ions, and 40 to 60 ppm of nickel ions, or (B) 4,000 ppm of zinc ions, 12,300 ppm of phosphate ions, 3,300 ppm of nitrate ions, and 200 to 400 ppm of a chelating agent. The main agent having the above-mentioned components is concentrated 5 to 40 times to produce the replenishing liquid of the main agent. The auxiliary A can be an aqueous solution containing approximately 5% by weight of sodium nitrite ($NaNO_2$). The auxiliary B can be an aqueous solution containing from 1% to 2% by weight of caustic soda (NaOH). The auxiliaries A and B are incorporated into either the main agent (A) or the main agent (B) to provide a conversion bath. An oxidizer other than $NaNO_2$, e.g., sodium chlorate, may be used.

Figure 2:
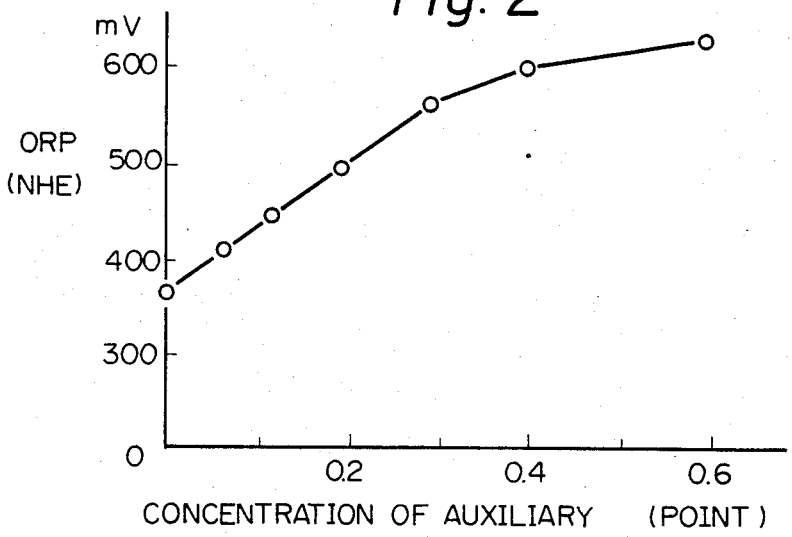
FIG. 2 is a graph showing the relationship between the ORP and the auxiliary concentration in the conversion bath of the present invention.

Referring to FIG. 2, the relationship between the ORP and the content of sodium nitrite ($NaNO_2$) is shown. This content is determined by conventional chemical analysis and is shown by points.

According to a feature of the present invention, the conversion bath has a temperature of from 25° C. to 30° C. and a pH of 2.9, and the amount of sludge in the bath is very small. Under these conditions, the ORP and the concentration of the auxiliary A have a definite co-relationship, as is apparent from FIG. 2. The ORP at a predetermined concentration of the auxiliary A varies depending upon the kind of auxiliary A and the kind of main agent.

Properties of Phosphate Coating

The chemical conversion phosphate coating obtained by the method of the present invention is dense as compared with that obtained by a conventional method and therefore exhibits an improved corrosion resistance and elongation when worked with a cold-forming press. One reason for the attaining of such an improved coating can be explained by empirical knowledge of the electrochemical reactions occurring on the metal surface, which empirical knowledge was obtained in plating and the like. Empirically, when the composition and the concentration of the anions in the solution are identical, the electrolytic deposit (coating) on the metal surface is denser and more stable and the overvoltage of the metal surface is higher. The overvoltage drastically decreases with a temperature elevation, and the higher the temperature is, the more likely it is that an unstable film consisting of coarse crystals will be obtained. Considering these points, it seems that, in the conversion bath according to the present invention having a lower temperature than a conventional conversion bath, the coating is formed under a high overvoltage and is therefore dense and stable.

Advantages of Method

In addition to improved properties of phosphate coating and simple and automatic bath control, the following advantages are attained by the present invention.

Intensional heating of the conversion bath, which is carried out in a conventional method, is unnecessary, thereby rendering the use of thermal energy unnecessary. Since the self-decomposition reactions of the conversion agents are slight, they can be used effectively, and the amount of conversion agents used can be decreased to as low as one fifth that of a conventional method. Because of this advantage, the amount of sludge can be drastically decreased. A settling tank, which is indispensable for equipping a conventional treating tank 1, is unnecessary.

The present invention is hereinafter described by using an example.

EXAMPLE

Figure 3:
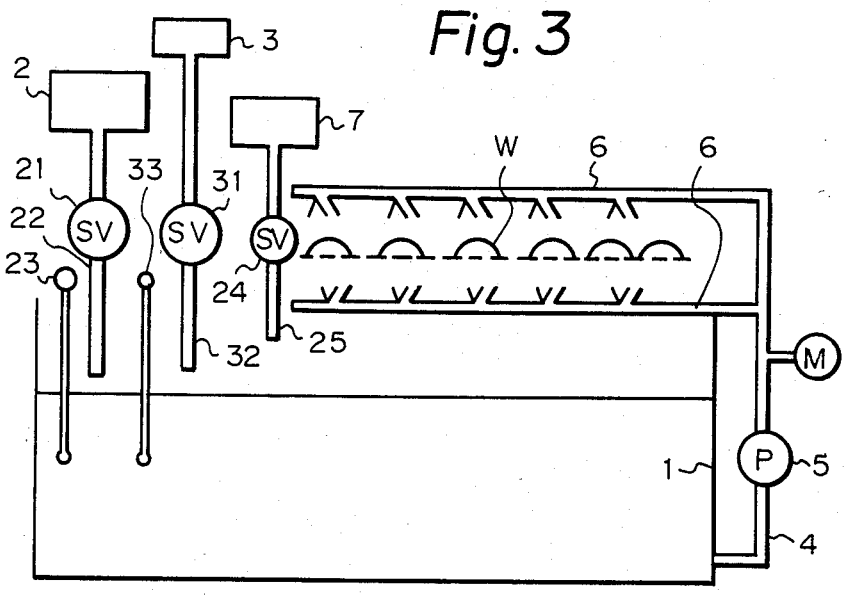
FIG. 3 schematically illustrates a conversion apparatus used in the examples of the present invention.

A treating tank 1 (shown in FIG. 3) was filled with 0.7 $m^3$ of a conversion solution. The conversion bath contained 5,000 ppm of zinc ions, 15,000 ppm of phosphate ions, 4,500 ppm of nitrate ions, and from 40 to 60 ppm of nickel ions. The treating tank 1 was communicated with a main-agent tank 2 via a main-agent feeding pipe 22 equipped with a solenoid valve 21, with an auxiliary B tank 7 via an auxiliary B feeding tank 25 equipped with a solenoid valve 24, and with an auxiliary A tank 3 via an auxiliary A feeding pipe 32 equipped with a solenoid valve 31. The solenoid valves 21, 24, and 31 were operably connected with a pH meter 23 and an ORP meter 33 dipped into the bath via an electric circuit (not shown) which could be closed by the pH meter 23 and the ORP meter 33. The solenoid valve 21 opened when the pH of the conversion bath measured by the pH meter 23 increased to 3.0 or more, thereby feeding the main agent from the main-agent tank 2 into the conversion bath. The solenoid valve 21 closed when the pH of the conversion bath measured by the pH meter 23 decreased to 2.7 or less. In addition, the solenoid valve 24 opened when the pH of the conversion bath measured by the pH meter 23 was less than 2.7, thereby feeding the auxiliary B from the auxiliary B tank 7 into the conversion bath. The solenoid valve 24 closed at a pH of 2.7 or more. The solenoid valve 31 opened when the ORP meter 33 (a silver chloride electrode) showed 400 mV or less in terms of the normal hydrogen standard electrode potential, thereby feeding the auxiliary A from the auxiliary A tank 3 into the conversion bath. The solenoid valve 31 closed at an ORP of 420 mV or more.

The treating tank 1 was provided with a spraying pipe 4 on a sidewall thereof. An upper row and a lower row of spraying nozzles 6 were disposed above and communicated with the treating tank 1 via the spraying pipe 4, which was equipped with a pump 5. The conversion solution was sprayed over the workpieces W from above and below. For the purpose of replenishment, 1.4 g of zinc, 4.0 g of phosphoric acid, 0.8 g of nitric acid, and 0.05 g of nickel were supplied to the bath per minute, in the form of an aqueous solution, as the main agent; 1.4 g of nitrite ions were supplied to the bath per minute, in the form of an aqueous solution containing nitrite ions, as the auxiliary A; and 0.14 g of $OH^-$ was supplied to the bath per minute, in the form of an aqueous solution as the auxiliary B.

The workpieces W were automobile starter covers which were formed by press-forming a cold-rolled sheet into the form of a cup 9 cm in diameter. The workpieces W were subjected to the following processes: degreasing, carried out by spraying an alkaline aqueous solution thereon at 55° C. for 2 minutes; rinsing, carried out with hot water 45° C. for 0.5 minute; spray rinsing, carried out with room-temperature water (20°–30° C.) for 0.5 minute; formation of a zinc phosphate coating in the apparatus shown in FIG. 3, carried out by spraying zinc phosphate solution thereon for 2 minutes; spray rinsing, carried out with room-temperature water for 0.5 minutes; repeating spray rinsing with room-temperature water for 0.5 minutes; and drying, carried out with warm air (80° C.–90° C.) for 2 minutes. The zinc phosphate coating was mainly composed of iron phosphate and zinc phosphate.

In the above-described apparatus, 1,500 workpieces were treated per hour, and both control was completely automatized during the treatment. This treatment was continued for 180 days, and during this time, no abnormalities whatsoever arose in the conversion bath.

Figure 4:
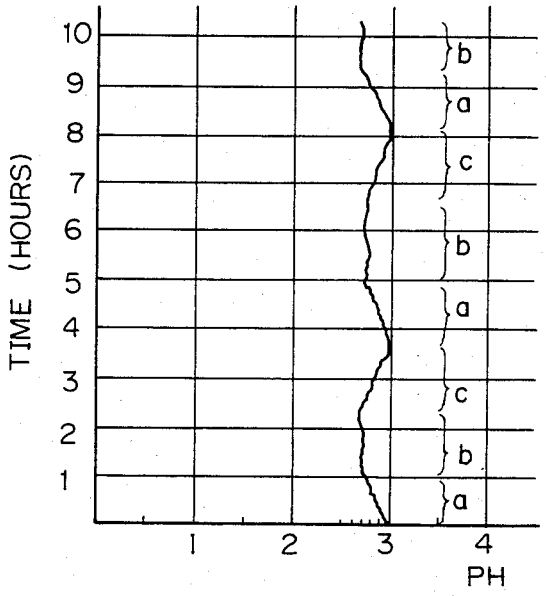
FIG. 4 is a chart showing the pH value recorded in an automatic control method carried out in an example of the present invention.

The pH control system used was manufactured from a pH electrode (produced by Denki Kagaku Keisoku Co., Ltd. under the name of UHC-76-6045-type pH electrode) and a pH recorder (produced by Denki Kagaku Keisoku Co., Ltd. under the name of HBR-92-type recorder). Part of the pH recording chart is shown in FIG. 4. The abscissa and the ordinate in FIG. 4 indicate the pH and the time, respectively. Each section in the ordinate corresponds to one hour. Replenishment of the main agent and the auxiliary B was started at the beginning of the time period "a" and was stopped at the end of the time period "a". Replenishment of the main agent was started when the pH was 3.0. When the pH decreased to 2.7 one hour after the start of replenishment of the main agent, the replenishment was stopped, and, simultaneously, re-plenishment of the auxiliary B was started. In the time period "b", the main agent was not replenished. At a pH of more than 2.7, the auxiliary B was not replenished but at a pH of less than 2.7 it was replenished. In the time period "c", the pH increased due to a decrease in the $NO_3^-$ concentration in accordance with the formation of the coating. In the conversion bath, the pH values as shown by "a", "b", and "c" in FIG. 4 alternately appeared. In all of the time periods "a", "b", and "c", the coating was applied on the workpieces.

The variation of the pH values shown in FIG. 4 was slight. This was because the dissociation constant of the phosphoric acid was small.

The ORP control system was manufactured from an ORP meter (produced by Denki Kagaku Keisoku Co., Ltd. under the name of UHC-76-6026-type metal electrode [silver chloride electrode]) and an ORP control recorder (produced by Denki Kagaku Keisoku Co., Ltd. under the name of HBR-94-type control recorder).

A silver chloride electrode is conventionally used, and its potential can be converted to the normal hydrogen electrode potential as follows.

$$E(\text{NHE}) = E(\text{AgCl}) + 206 - 0.7(t - 2.5)\ mV \quad (14)$$

E(NHE) . . . normal hydrogen electrode potential
E(AgCl) . . . 3.33 M KCl=AgCl electrode potential
t . . . temperature (°C.)

As is described above, the pH and ORP values herein are those at the operating temperature. Therefore, the 0.7(t−25) of the formula (14) is not considered.

Figure 5:
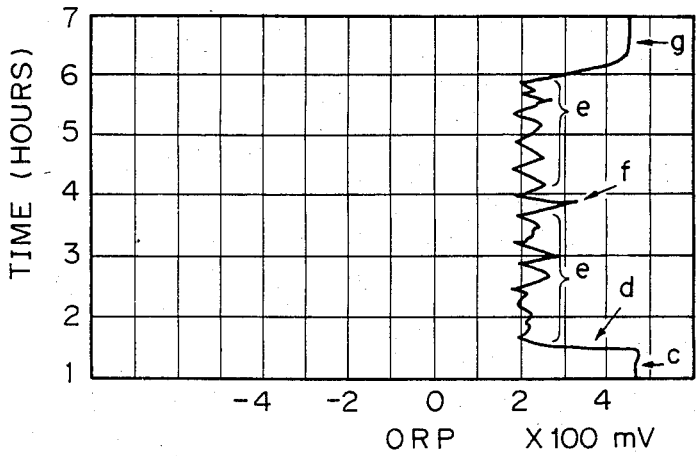
FIG. 5 is a chart similar to that of FIG. 4 and shows the ORP value.

In the time period "c" of FIG. 5, operation of the conversion apparatus was started, but the workpieces were not at that time subjected to chemical conversion.

The potentials of the reactions (5) and (12) were predominant over the ORP in the conversion bath, and the ORP was therefore high. An electrochemical circuit can be said to be cut off at the cathode reaction state.

In the time period "d", since the workpieces were subjected to chemical conversion, the reactions (2), (3), and (4) occurred to form the coating, along with the cathode reaction. As a result, the ORP of the conversion bath drastically decreased.

In the time period "e", the incorporation of the auxiliary A was automatically controlled in accordance with the ORP value. Feeding of the auxiliary A into the treating tank was started when the ORP value decreased to 200 mV and was stopped when the ORP value reached 220 mV. During such control, the ORP of the conversion bath was maintained within a constant range of from 180 to 220 mV, which was the AgCl electrode potential value.

In the time period "f", the chemical conversion of the workpieces (steel) was interrupted, and, hence, the ORP increased. The ORP was immediately restored to its original value when treatment of the workpieces was resumed.

In the time period "g", like in the time period "c", the workpieces were not subjected to a conversion treatment, and, therefore, the ORP value was determined by the cathode reaction potential and was increased abruptly.

As is described above, a completely electrochemical and automatic control of the conversion bath was attained, in accordance with the present invention.

Incidentally, an electrochemical reaction between the conversion solution and the material of the treating tank should be prevented by using highly insulating material, e.g., a rubber lining, for the tank.

The workpieces, on which the phosphate conversion coating was applied, were spray-coated with black epoxi-urethane resin paint. After setting for 3 minutes, the paint was cured in a curing furnace at 140° C. for 6 minutes, thereby obtaining a 12∼18 μm thick paint coating. Forty-eight hours after the curing, the painted workpieces were subjected to the salt spray test specified in JIS K-5400-7.8 so as to investigate the corrosion resistance of the paint coating.

For the purpose of comparison, a conventional chemical conversion was carried out to apply phosphate coating on the workpieces and then the paint coating was applied as described above.

In the conventional chemical conversion method used in the present example, the bath temperature was from 50° C. to 55° C., the pH was from 3.1 to 3.3, and the ORP was from 730 mV to 750 mV. The components of the main agent and the auxiliary A were the same as those of the example according to the present invention.

Figure 6:
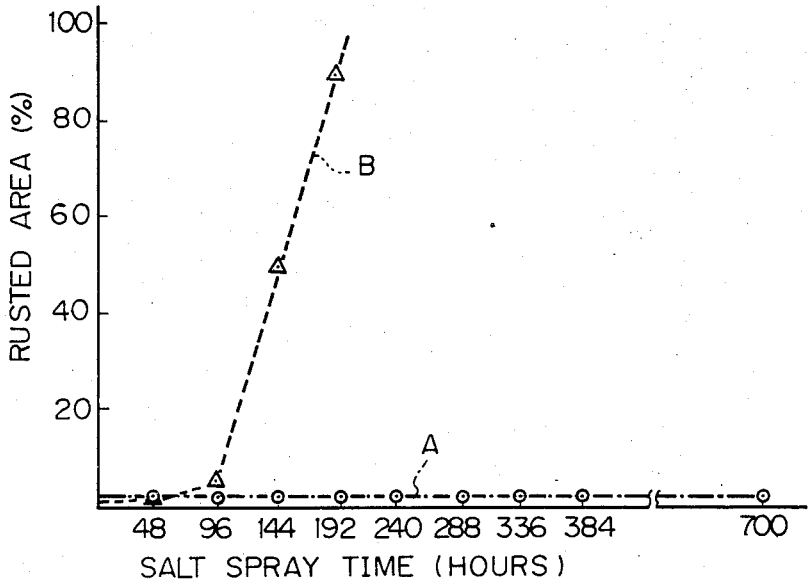
FIG. 6 is a graph showing the relationships between the salt spraying time and the rusted area with regard to a painted article processed by the method of the present invention and one processed by a conventional method.

The results of the salt spray test are shown in FIG. 6. The symbol A indicates the relationship between the rusted area (%) and the salt spray time of the painted workpieces subjected to the method of the present invention. The symbol B indicates the relationship between the rusted area (%) and the salt spray time with regard to a conventional method. As is apparent from a comparison of the line A and the line B, the corrosion resistance of the workpieces conversion-treated according to the present invention is considerably superior to that of the workpieces conversion-treated according to a conventional method.

I claim:

1. A method of forming a chemical conversion phosphate film on the surface of steel parts comprising the steps of:

(a) bringing said steel parts into contact with a conversion bath containing materials participating in the chemical conversion reactions, including a conversion-coating agent, an oxyacid anions, and an oxidizer, and maintaining the conversion bath within the range of from 0° C. to 40° C.;

(b) predetermining a hydrogen-ion concentration (pH) of the conversion bath in the range of from pH 2.2 to pH 3.5 and oxidation reduction potential (ORP) of the conversion bath in a range of from 0 mV to 700 mV (normal hydrogen electrode potential), so that concentrations of said materials is controlled and maintained to form said chemical conversion phosphate film on the surface of the steel parts, and further, that said pH an ORP ranges in combination with said temperature range produce, in step (a), a relationship between the concentration of said oxidizer said ORP, indicating at a given ORP value of the concentration of said oxidizer;

(c) measuring the hydrogen-ion concentration of the conversion bath during the step (a);

(d) measuring an oxidation reduction potential (ORP) of said conversion bath during the step (a);

(e) replenishing a main agent containing phosphate ions, when the measured pH rises above a value predetermined within said range of pH 2.2 to 3.5;

(f) replenishing said oxidizer, when the measured ORP decreases to less than a value predetermined within said range of 0 to 700 mV;

(g) when, due to an increase in a relative amount of the oxyacid anions to conversion-coating agents, said measured pH value falls below a value predetermined within said range of pH 2.2 to 3.5, replenishing alkali and thereby removing the oxyacid anions by added alkali, and maintaining concentrations of said materials to form said chemical conversion phosphate film;

(h) repeating replenishing steps (e), (f), and (g) during the step (a) as required, thereby maintaining said concentrations of materials during the chemical conversion of steel parts.

2. A method according to claim 1, wherein a sludge, if any, in the chemical conversion bath is formed by a reversible reaction.

3. A method according to claim 2, characterized in that said replenishments of the main agent and the oxidizer are automatically carried out by using a pH meter and an ORP meter, respectively, and the replenishment of the alkali is automatically carried out by using a pH meter.

4. A method according to claim 3, wherein said pH meter is operably connected to a pump or a solenoid valve of a feeding pipe which communicates a main-agent tank with said conversion bath and to a pump or a solenoid valve of a feeding pipe which communicates an auxiliary B tank containing alkali with said conversion bath, and, further, said ORP meter is operably connected with a pump or a solenoid valve of a feeding pipe for communicating an oxidizer tank with said conversion bath.

5. A method according to claim 2, wherein said oxidizer is nitrite ions.

6. A method according to claim 3, wherein replenishment of alkali is carried out at an ORP of 300 mV or more.

7. A method for forming a chemical conversion phosphate film on the surface of steel parts by a general corrosion reaction of said steel parts, said method comprising the steps of:

(a) bringing said steel parts into contact with a conversion bath maintained within a range of from 0° C. to 40° C.;

(b) maintaining the hydrogen-ion concentration (pH) of the conversion bath in the range of from pH 2.2 to pH 3.5 and maintaining the oxidation reduction potential (ORP) of the conversion bath in a range of from 0 mV to 700 mV (normal hydrogen electrode potential);

(c) replenishing a main agent containing phosphate ions, oxyacid anions, and metal ions, when the pH rises above a value predetermined within said range of pH 2.2 to 3.5;

(d) when the ORP decreases to less than a value predetermined within said range of 0 to 700 mV, replenishing said oxidizer in an amount determined by a relationship between the concentration between said oxidizer and said ORP, indicating at a given ORP one value of the concentration of said oxidizer;

(e) when said pH value falls below a value predetermined within said range of pH 2.2 to 3.5, replenishing alkali.

8. A method according to claim 7, wherein an anode reaction of the general corrosion reaction causes a formation of a phosphate film on said surface of steel parts, and a cathode reaction of the general corrosion reaction causes a reduction of the oxidizer and proton ($H^+$) which is formed by the anode reaction.

9. A method according to claim 8, wherein said oxidizer is $NO_2^-$.

10. A method according to claim 7, wherein said alkali causes a reaction to remove oxyacid anions from the bath by an electrochemical reaction in the bath.

* * * * *

UNITED STATES PATENT AND TRADEMARK OFFICE

CERTIFICATE OF CORRECTION

PATENT NO. : 4,565,585

DATED : January 21, 1986

INVENTOR(S) : MATSUDA

It is certified that error appears in the above-identified patent and that said Letters Patent is hereby corrected as shown below:

Title page:

Assignment Data Incomplete. Should read:

--Assignee: Nippondenso Co., Ltd., Kariya, Japan, and Nihon Parkerizing Co., Ltd., Tokyo, Japan--

Signed and Sealed this

*Fifteenth* Day of *July 1986*

[SEAL]

*Attest:*

*Attesting Officer*

DONALD J. QUIGG

*Commissioner of Patents and Trademarks*